US010912972B1

(12) United States Patent
Fortin

(10) Patent No.: US 10,912,972 B1
(45) Date of Patent: Feb. 9, 2021

(54) SINGLE-HANDED GOLF SWING APPARATUS

(71) Applicant: Lawrence Fortin, Salisbury, MA (US)

(72) Inventor: Lawrence Fortin, Salisbury, MA (US)

( * ) Notice: Subject to any disclaimer, the term of this patent is extended or adjusted under 35 U.S.C. 154(b) by 0 days.

(21) Appl. No.: 16/722,130

(22) Filed: Dec. 20, 2019

(51) Int. Cl.

| | |
|---|---|
| ***A63B 53/16*** | (2006.01) |
| ***A63B 60/14*** | (2015.01) |
| ***A63B 53/14*** | (2015.01) |
| ***A63B 71/00*** | (2006.01) |
| *A63B 60/10* | (2015.01) |

(52) U.S. Cl.
CPC ..... *A63B 60/14* (2015.10); *A63B 53/14* (2013.01); *A63B 71/0009* (2013.01); *A63B 60/10* (2015.10)

(58) Field of Classification Search
CPC ..... A63B 60/10; A63B 60/14; A63B 53/14; A63B 71/0009
See application file for complete search history.

(56) References Cited

U.S. PATENT DOCUMENTS 1,587,082 A * 6/1926 Mattern ..... A63B 53/14 473/201
2,962,288 A * 11/1960 Lowden ..... A63B 53/007 473/206
4,819,939 A * 4/1989 Kobayashi ..... A63B 60/14 473/299
4,974,846 A * 12/1990 Fenton ..... A63B 53/14 473/303
5,704,845 A * 1/1998 Boyte ..... A63B 69/3608 473/205
6,857,971 B2 * 2/2005 Huang ..... A63B 60/54 473/300
7,591,733 B1 * 9/2009 Kurisu ..... A63B 53/14 473/206
7,887,428 B2 * 2/2011 Kurisu ..... A63B 53/14 473/206
8,118,686 B1 * 2/2012 Kurisu ..... A63B 53/14 473/206
2005/0148410 A1 * 7/2005 DeLisle ..... A63B 57/10 473/387
2020/0047042 A1 * 2/2020 Ianazone ..... A63B 69/3632

FOREIGN PATENT DOCUMENTS

GB 322512 A * 12/1929 ..... A63B 60/10

* cited by examiner

*Primary Examiner* — Stephen L Blau
(74) *Attorney, Agent, or Firm* — Patent Negotiator, PLLC; Sarita L. Pickett

(57) ABSTRACT

The present invention is a mono-manual golf swing apparatus. More particularly, the apparatus is an accessory for a golf club which facilitates singular manual dexterous handling of a golf club and eliminates unintended slipping while swinging. Of further advantage, this apparatus may be easily removed, attached and detached single-handedly.

11 Claims, 6 Drawing Sheets

SINGLE-HANDED GOLF SWING APPARATUS

BACKGROUND OF THE INVENTION

1. Field of the Invention

The present invention relates generally to a golf accessory. Particularly, the present invention relates to a golf club grip accessory for handicapped individuals.

2. Description of the Prior Art

U.S. Pat. No. 8,894,503 B2 discloses a golf swing training aid intended for practice use by a golfer as a removable attachment to a standard golf club. The training aid comprises a specially adapted clamp assembly for releasable attachment to the grip of the golf club, a handle member projecting rearward from the clamp assembly, and a bowed guide arm member extending forwardly from the clamp assembly and further engaging the grip so that the guide arm projects between the forearms of the golfer when his hands are positioned normally upon the grip. The clamp assembly comprises a deployable crown assembly of flexible finger members mounted in a radial configuration and fitted to move into and from within a collar housing in such a fashion as to selectively engage and release the grip end of the golf club.

History of Disabilities in Sports

There have been several milestones in the advancement of other-abled individuals' participation in sports. Some of the advancements have been technical, such as the advancements with artificial limbs, e.g., German American gymnast, George Eyser, competed in the 1904 Olympic Games with an artificial leg. Other times, the advancement is purely individual, such as Hungarian Karoly Takacs, a right-arm amputee that could shoot left-handed. Another disabled athlete to appear in the Olympics prior to the Paralympic Games was Lis Hartel, a Danish equestrian athlete who had contracted polio in 1943 and won a silver medal in the dressage event.

More recently, many of the advancements have been political and organizational, such as the inception of the Paralympics in 1960. The International Paralympic Committee (IPC), the global governing body of the Paralympics has established ten disability categories, including visual impairment, intellectual impairment, and eight different types of physical impairment:

(1) Impaired muscle power—the force generated by muscles, such as the muscles of one limb, one side of the body or the lower half of the body is reduced, (e.g. spinal cord injury, spina *bifida*, post-polio syndrome).

(2) Impaired passive range of movement—Range of movement in one or more joints is reduced in a systematic way.

(3) Loss of limb or limb deficiency—A total or partial absence of bones or joints from partial or total loss due to illness, trauma, or congenital limb deficiency (e.g. dysmelia).

(4) Leg-length difference—Significant bone shortening occurs in one leg due to congenital deficiency or trauma.

(5) Short stature—Standing height is reduced due to shortened legs, arms and trunk, which are due to a musculoskeletal deficit of bone or cartilage structures. (e.g. achondroplasia, growth hormone deficiency, osteogenesis imperfecta)

(6) Hypertonia—Hypertonia is marked by an abnormal increase in muscle tension and reduced ability of a muscle to stretch. Hypertonia may result from injury, disease, or conditions which involve damage to the central nervous system (e.g. cerebral palsy).

(7) Ataxia—Ataxia is an impairment that consists of a lack of coordination of muscle movements (e.g., cerebral palsy, Friedreich's ataxia, multiple sclerosis).

(8) Athetosis—Athetosis is generally characterized by unbalanced, involuntary movements and a difficulty maintaining a symmetrical posture (e.g. cerebral palsy, choreoathetosis).

SUMMARY OF THE INVENTION

Advantages and Differences of Invention Over Known Prior Art

Despite the progress that has been made in several sports, there is still room to be made, especially in the sport of golf. For example, while the Special Olympics recognizes golf and celebrates the success of their athletes in this sport, the Summer Paralympics has yet failed to recognize this category.

While there are a myriad of grip adjustment or grip guides available for golfers, these are all designed to facilitate a dual-hand grip. These grip assistants are also prohibited from PGA tournaments. This means that those who wish to play professionally must either rely upon prosthetics or risk the translational motion conversion into improper rotation during the swing as illustrated in FIG. 1.

The golf swing may appear outwardly similar to many other motions, such as swinging a tool, or swinging a baseball bat. However, unlike many of these other motions, the longer length of the golf club, and the smaller target area of golf ball means that a golf swing must be much more precise to obtain even a mediocre result. Indeed, the result of a golf swing is highly dependent on several sub-motions being properly aligned and timed.

These sub-motions need to address the length of club, the type of turf, and the type of club, just for starters. These sub-motions also need to ensure that the club travels up to the ball in line with the desired path; that the clubface is in line with the swing path; and that the ball hits a center or "sweet spot" of the clubface. The ability to do this consistently, across a complete set of clubs with a wide range of shaft lengths and clubface areas, is a key skill for any golfer, and takes a significant effort to achieve.

Those who deal with one of the established physical disability categories listed above, have these same concerns during a swing, such as hip rotation, and shoulder rotation. However, without the additional stabilization provided by a secondary support inherently provided by a second grip upon the lance of the club, inadvertent rotation slippage often also occurs about the shaft.

One possible alternative to address this slippage is the sports glove. However, sports gloves do not meet all of the necessary requirements and pose further difficulties in removal for those with a physical disability as a sports glove often has fitted closures (hook and loop or elastic). Thus, the very form-fitting nature of a glove capable of providing assistance in meeting the needs of a golfer means that the glove cannot be easily removed during a game round. Unlike gloves, which inevitably surround the palm, the present inventive apparatus does not require a second hand to remove from a user's hand.

Objects of the Present Invention

It is an object of the present invention to provide an apparatus which is able to assist a one-handed golfer reduce or eliminate inadvertent rotation about the shaft.

The present invention achieves these and other objectives by providing a single-handed golf swing apparatus which has at least one peg extending perpendicularly from an upper surface of a flexible saddle. The peg has a shaft with a first end and a second end, and a knob abutting and connecting with the second end of the peg. The apparatus has a saddle which abuts and connects with the first end of the peg, the saddle has a front edge, a midsection extends from the front edge to a rear edge, and at least one wing extends from the midsection normal to the first end of the shaft of the peg. A tip of at least one wing furthest apart from the midsection is capable of moving from a first position with respect to the midsection to a second position with respect to the midsection.

It is a further object of the present invention to provide a single-handed golf swing apparatus in which the knob of the peg has a radius which is greater than a radius of the shaft of the peg; and the first end and the second end of the shaft have one of a chamfer, fillet, and bevel such that a concavity is formed along a front surface and a rear surface of the shaft, facing the front edge and the rear edge of the saddle, respectively. The concavity has a depth of at least 0.5 mm, so that the overall diameter of the concavity is between 10 mm and 30 mm to facilitate a user's finger.

It is a further object of the present invention to provide a single-handed golf swing apparatus further having a margin along the edge of the saddle, the margin having a surface with a smooth continuous curvature extending from an upper surface to a bottom surface, so as to eliminate any sharp or rough edges which might catch upon a user's skin.

It is a further object of the present invention to provide a single-handed golf swing apparatus which has a saddle with an upper surface having a plurality of microcavities capable of providing increased frictional interaction between the upper surface and a user's hand.

It is a further object of the present invention to provide a single-handed golf swing apparatus which has a saddle with a bottom surface having a plurality of microcavities capable of providing increased frictional interaction between the bottom surface and a golf club shaft.

The single-handed golf swing apparatus of claim 1 further comprising a plurality of channels along a surface of the saddle extending at an angle approaching normal to the front edge to the rear edge.

DETAILED DESCRIPTION OF THE INVENTION

Figure 1:
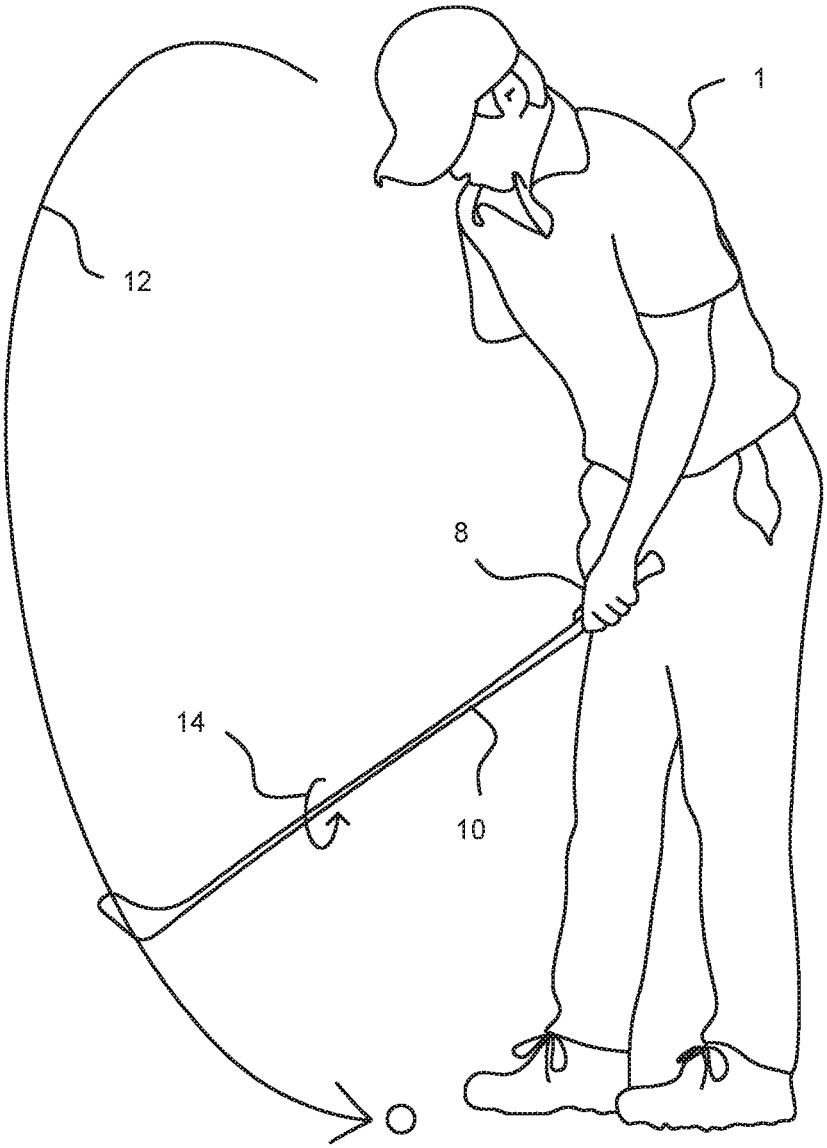
FIGURE 1 (Prior Art)
FIG. 1 is an illustration of the inadvertent rotation which occurs in the prior art during a backswing of a golfer.
Figure 2:
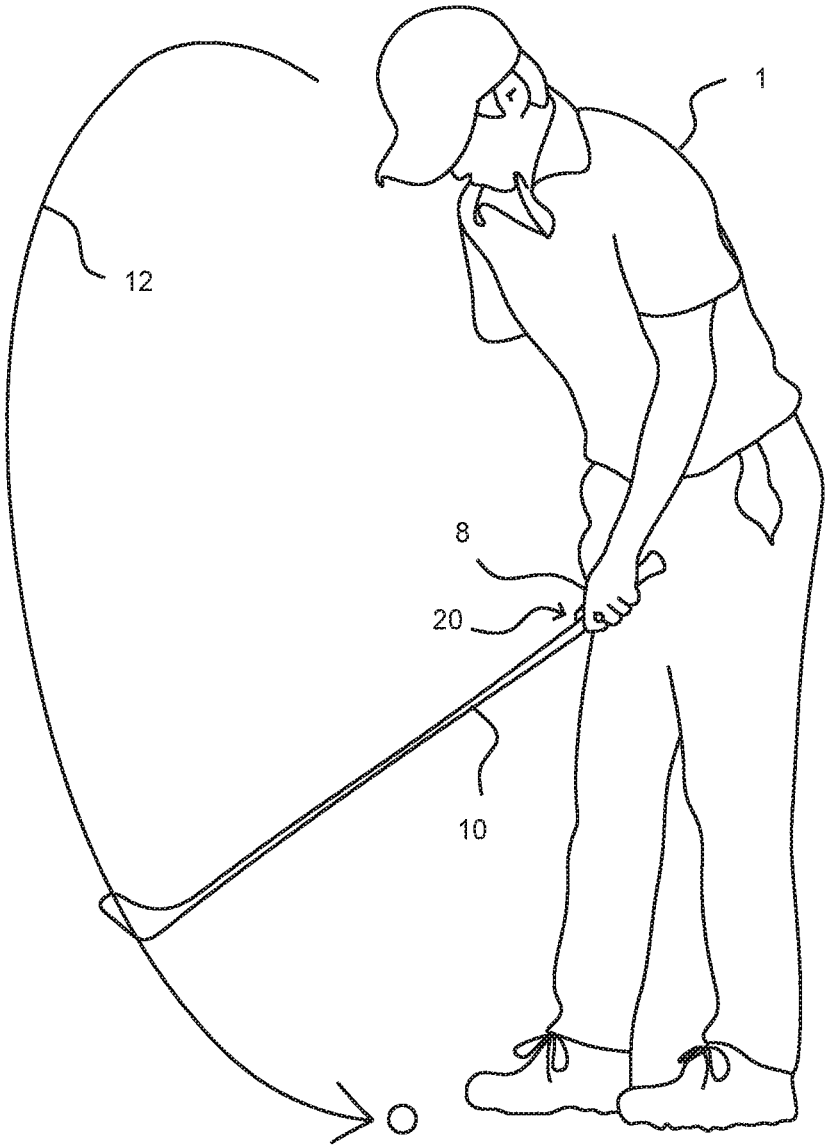
FIG. 2 is an illustration of the backswing of a golfer employing an embodiment of the present invention—facilitating in preventing the same inadvertent rotation shown in FIG. 1.

A first embodiment of the present invention is illustrated in FIGS. 2-9. As previously discussed, this apparatus is constructed to assist a one-handed golfer reduce or eliminate inadvertent rotation about the shaft during a golf swing. As illustrated in FIG. 2, several embodiments of the present invention 20 are designed to be discreetly sized so as to be minimally visible when used. The smaller size facilitates easy storage within a user's trouser pocket. The smaller size also facilitates easy attachment and reattachment to multiple golf clubs during a round.

Figure 3:
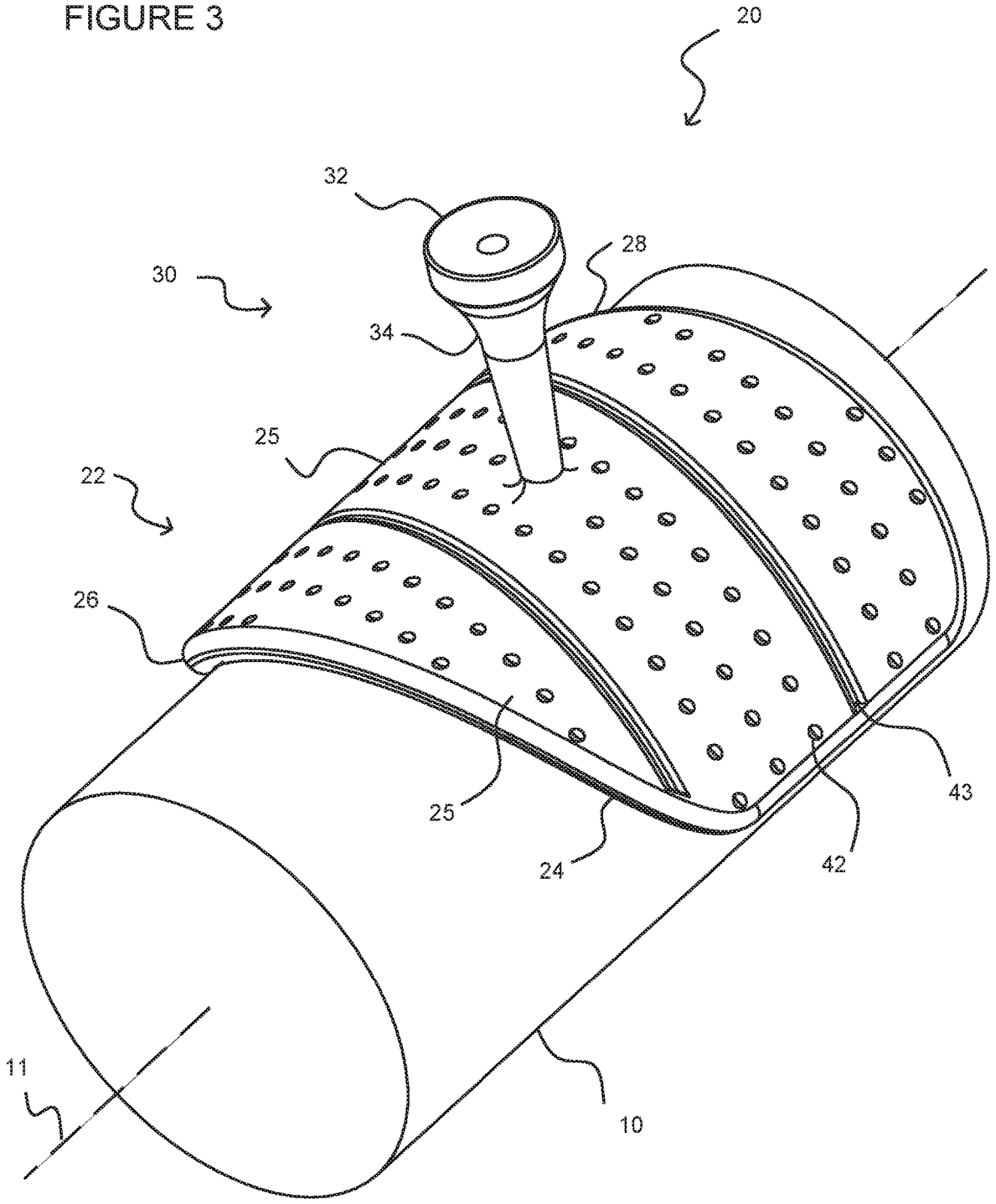
FIG. 3 is an upper perspective view of an embodiment according to the present invention along the lance of a club.
Figure 4:
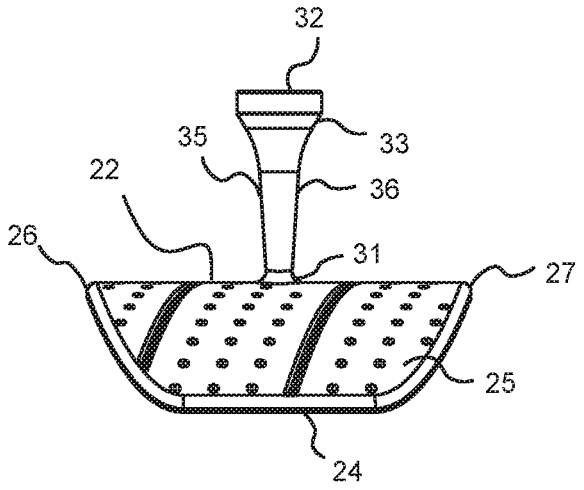
FIG. 4 is a side view of the embodiment according to FIG. 3.
Figure 5:
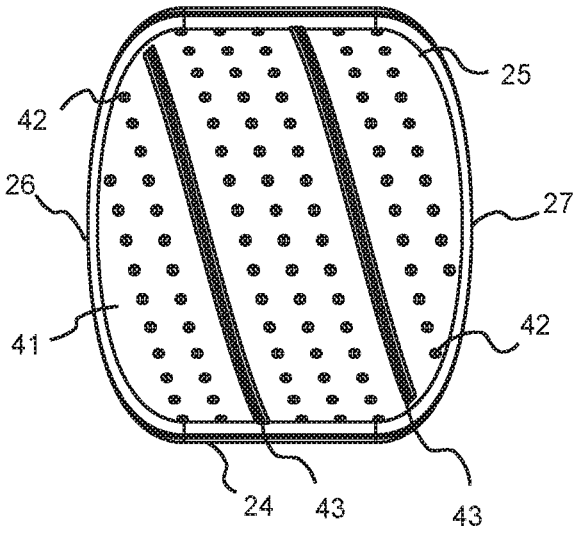
FIG. 5 is a bottom view of the embodiment according to FIG. 3.
Figure 6:
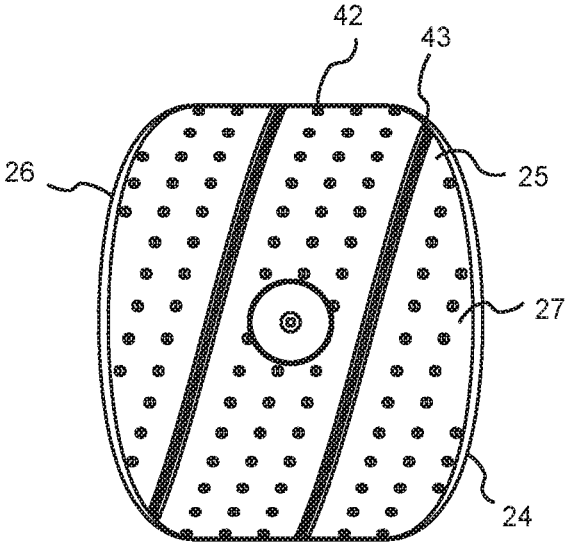
FIG. 6 is a top view of the embodiment according to FIG. 3.
Figure 7:
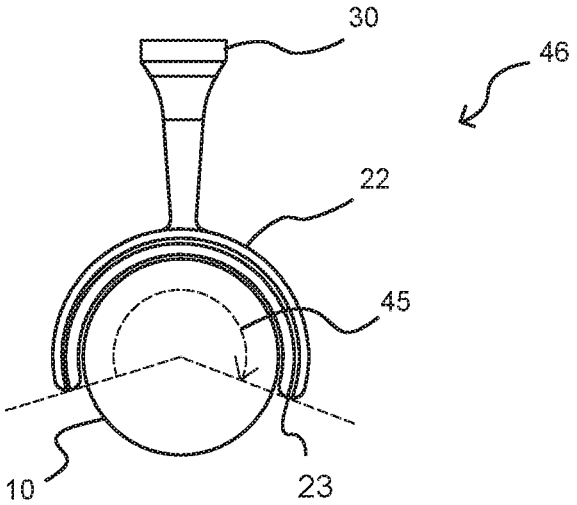
FIG. 7 is a side view of the embodiment according to FIG. 3 in a first position shown with respect to a golf lance.
Figure 8:
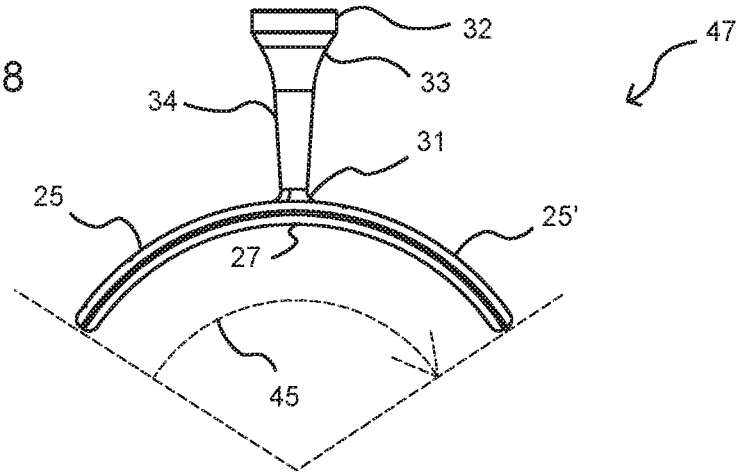
FIG. 8 illustrates a side view of the embodiment according to FIG. 3 in a second position.

Shown in FIGS. 3-9 are various perspective views of an embodiment 20 according to the present invention. FIG. 3 and FIG. 7 illustrate this apparatus astride the lance of a club 10. A main saddle 22 has a midsection 27 which lies parallel to the axis 11 of the club 10. Two wings 25 extend from sides of the midsection 27 which extends from a front edge 26 to a rear edge 28 of the saddle 22. A margin 24 along a perimeter of the saddle 22 has a continuous curvature 23 from an upper surface 40 to a lower surface 41.

A peg 30 extends upwards perpendicularly from the midsection 27 of the main saddle 22. The knob 32 of the peg 30 has a larger size or diameter than a larger size or diameter of the shaft 34. First and second ends 31, 33 of the shaft 34 of the peg 30, connecting the knob 32 of the shaft 34 to the saddle 22, are generally filleted so that a concavity 37 is formed between the knob 32 and the upper surface 40 of the saddle 22.

A plurality of microcavities 42 along the upper surface 40 provide increased frictionally engaging support for a user's hand. Similarly, a plurality of microcavities 42 along the lower surface 41 provide increased frictional support along the lance of the club 10, such that the force of the user's hand is transmitted evenly and directly for gripping a handle of the golf club shaft 10. An upper surface 40 of the saddle 22 may also have channels which provide textural patterning designed to facilitate directional guidance for fingers.

Further increasing the degree of maneuverability and value to a user, the wings 25, 25' of the apparatus are capable of bending, flexing, or otherwise moving from a first position 46 with respect to the midsection 27 to a second position 47 with respect to the midsection 27. As shown generally in FIGS. 7-9, the wings 25, 25' may further bend or unbend so that the wings 25, 25' of the apparatus are capable of bending, flexing, or otherwise moving from a second position 47 with respect to the midsection 27 to a third position 48 with respect to the midsection 27. Examples of these positions are shown where the degree of curvature 45 of the wings 25 being 225 degrees, 95 degrees, and 0 degrees, respectively.

This flexibility is provided to ensure that this golf accessory is capable of being attached and detached one-handed to a golf club, and yet, small enough to fit in a user's pocket between holes on the course.

Further Embodiment

Figure 9:
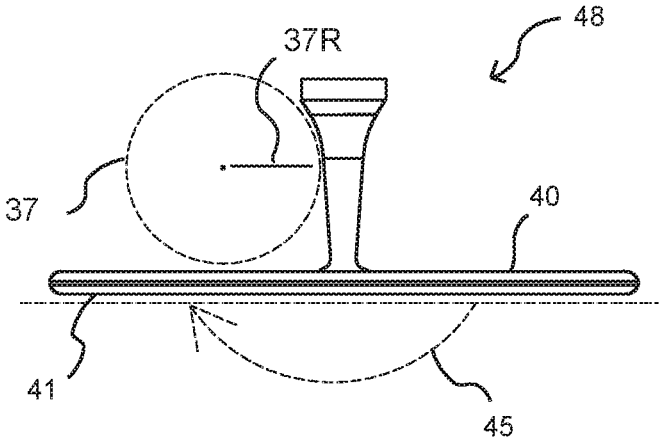
FIG. 9 illustrates a side view of the embodiment according to FIG. 3 in a third position.
Figure 10:
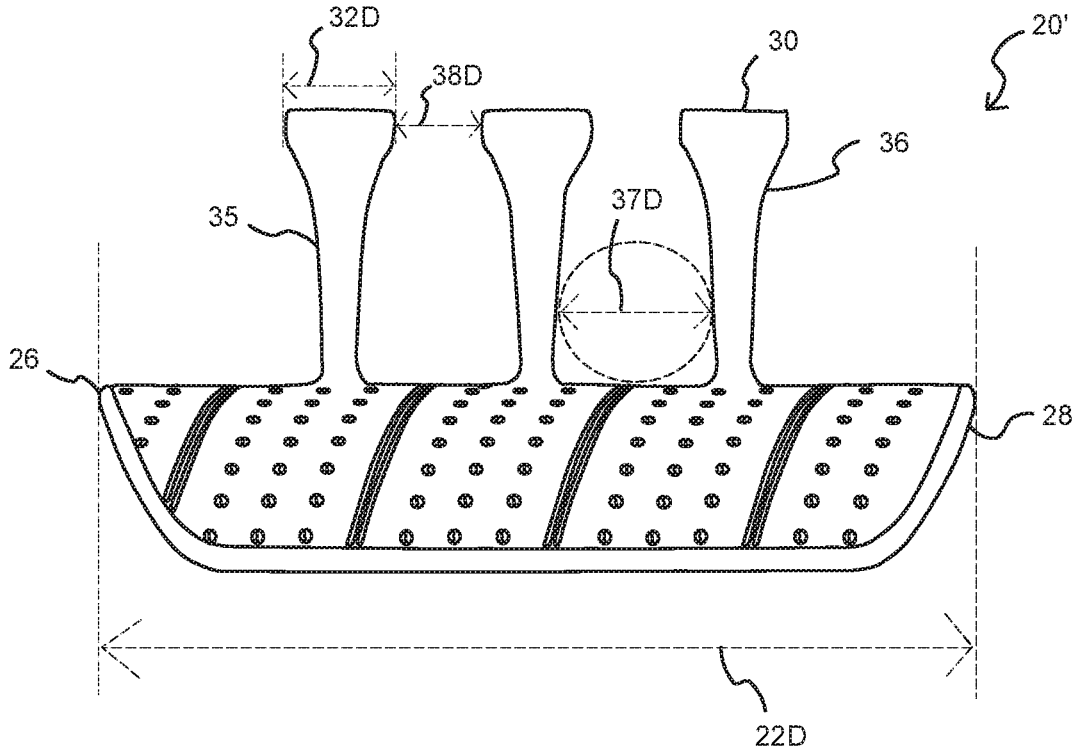
FIG. 10 is a side view of a further embodiment of the present invention.
Figure 11:
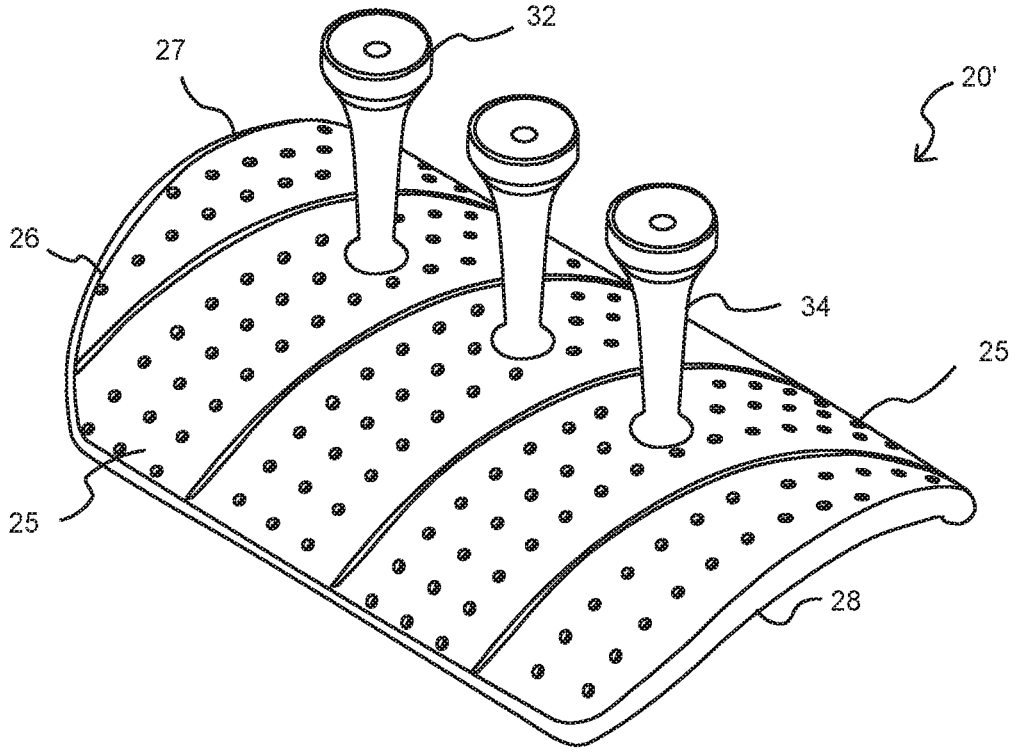
FIG. 11 is an upper perspective view of the embodiment shown in FIG. 10.

A further embodiment of the present invention is shown in FIGS. 9-10 having more than a single peg 30, so that a greater percentage of force of the entire grip of the hand may be directly applied to the golf club. As this embodiment is in general respects identical and the same as the embodiment, which is previously discussed above, no further description of the same is provided at this time.

Again, the overall length 22D of the saddle 22 being generally between 3-7 cm, preferably between 4-6 cm and more preferably of about 5 cm. The knobs 32 having an overall length 32D, being generally between 0.5 cm and 2 cm, and more preferably of about 0.8-1.2 cm, and even more preferably of at least 0.8 cm, but no greater than half the overall length of the saddle. The distance 38D between the knobs 32, being generally between 1 cm and 2 cm, and more preferably of less than half the overall length of the saddle. The concavity 37 between the pegs 30 having an overall distance 37D, with a radius 37R as shown in FIG. 9, being generally between 1.5 cm and 2 cm, more preferably of about 1.8 cm, or greater than the distance 38D between the knobs 32 but less than half the overall length 22D of the saddle 22.

LIST OF REFERENCED ELEMENTS

The following reference numbers are adhered to within the specification to refer to those referenced elements within the drawings of the present application.

| | |
|---|---|
| 1 | user |
| 4 | pocket |
| 8 | hand |
| 10 | club |
| 11 | axis |
| 12 | main swing |
| 14 | inadvertent rotation |
| 20 | main apparatus |
| 22 | saddle |
| 23 | continuous curvature |
| 24 | margin |
| 25 | wing |
| 26 | front edge |
| 27 | midsection |
| 28 | rear edge |
| 30 | peg |
| 31 | first end |
| 32 | knob |
| 33 | second end |
| 34 | shaft |
| 35 | concave front surface |
| 36 | concave rear surface |
| 37 | concavity |
| 38 | valley between knobs |
| 40 | upper surface |
| 41 | lower surface |
| 42 | microcavities |
| 43 | channels |
| 45 | degree of curvature of wing |
| 46 | First position |
| 47 | second position |
| 48 | third position |

CONCLUSION

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A single-handed golf swing apparatus, comprising:

a peg having a shaft with a first end and a second end, a knob abutting and connecting with the second end of the peg; and a saddle abutting and connecting with the first end of the peg, the saddle having a front edge, a midsection extending from the front edge to a rear edge, and at least one wing extending from the midsection normal to the first end of the shaft of the peg;

wherein a tip of at least one wing being capable of moving; and wherein the saddle is able to bend in at least one of from a flat planar orientation in the direction normal to the front edge to the rear edge direction to an orientation where the saddle curves to encompass at least 95 degrees of a first circumference of a first circle from a center of the first circle, or the saddle is able to bend in the direction normal to the front edge to the rear edge direction from a second curved orientation where the saddle curves to encompass an amount of a second circumference of a second circle from a center of the second circle to a third curved orientation where the saddle curves to encompass an amount of a third circumference of a third circle from a center of the third circle where the difference between the amount of the second circumference and the amount of the third circumference is at least 95 degrees.

2. The single-handed golf swing apparatus of claim 1 wherein the knob of the peg having a radius greater than a radius of the shaft of the peg; and the first end and the second end of the shaft have one of a chamfer, fillet, and bevel such that a concavity is formed along a front surface and a rear surface of the shaft, facing the front edge and the rear edge of the saddle, respectively.

3. The single-handed golf swing apparatus of claim 1 further comprising a margin having a surface with a smooth continuous curvature extending from an upper surface to a bottom surface.

4. The single-handed golf swing apparatus of claim 1 wherein the saddle having an upper surface having a plurality of microcavities capable of providing increased frictional interaction between the first layer and a user's hand.

5. The single-handed golf swing apparatus of claim 1 wherein the saddle having a bottom surface having a plurality of microcavities capable of providing increased frictional interaction between the bottom surface and a golf club.

6. The single-handed golf swing apparatus of claim 1 further comprising a plurality of channels along a surface of the saddle extending at an angle approaching normal to the front edge to the rear edge.

7. The single-handed golf swing apparatus of claim 1 wherein the first angle the saddle bends from the second curved orientation to the third curved orientation where the saddle curves to encompass 225 degrees of the third circumference of the third circle from the center of the third circle.

8. The single-handed golf swing apparatus of claim 1 wherein the knob extends from the saddle at a point which is half-way between the front edge and the rear edge of the saddle.

9. The single-handed golf swing apparatus of claim 1 wherein an overall length of the saddle extending from the front edge to the rear edge being between 4-6 cm.

10. The single-handed golf swing apparatus of claim 1 wherein a distance from the front edge of the saddle to the knob is at least 1.5 cm and a distance from the rear edge of the saddle to the knob is at least 1.5 cm.

11. The single-handed golf swing apparatus of claim 1 wherein an overall length of the knob being saddle being between 0.5 cm and 2 cm.

* * * * *